US005947686A

United States Patent [19]

Keyes

[11] Patent Number: 5,947,686

[45] Date of Patent: Sep. 7, 1999

[54] FAN BLADE COVERS

[76] Inventor: Tina M. Keyes, 5345 Midland Rd., Sarasota, Fla. 34231

[21] Appl. No.: 09/042,180

[22] Filed: Mar. 12, 1998

[51] Int. Cl.[6] ..... F04D 29/00; F04D 29/70

[52] U.S. Cl. ..... 416/61; 416/62; 416/144; 416/146 R; 416/5; 239/35; 239/45; 239/51.5; 239/55; 422/124

[58] Field of Search ..... 416/5, 61, 62, 416/146 R, 144, 145; 239/35, 45, 51.5, 55, 57; 422/122, 123, 124; 96/222, 226, 227

[56] References Cited

U.S. PATENT DOCUMENTS

| | | | |
|---|---|---|---|
| 680,689 | 8/1901 | Bradshaw | 422/124 |
| 725,086 | 4/1903 | Jacobs | 422/124 |
| 2,430,948 | 11/1947 | Platt | 416/144 |
| 4,676,721 | 6/1987 | Hardee | 416/146 R |
| 4,753,573 | 6/1988 | McKnight . | |
| 4,832,572 | 5/1989 | Prucha et al. . | |
| 4,854,374 | 8/1989 | Harrison . | |
| 4,889,543 | 12/1989 | Burt . | |
| 5,022,819 | 6/1991 | Murcin et al. . | |
| 5,110,261 | 5/1992 | Junkin . | |
| 5,163,616 | 11/1992 | Bernarducci et al. | 239/35 |
| 5,242,111 | 9/1993 | Nakoneczny et al. | 239/55 |
| 5,273,398 | 12/1993 | Reinfelder et al. | 416/144 |
| 5,516,264 | 5/1996 | Anetrini | 416/62 |
| 5,564,900 | 10/1996 | McAuley | 416/62 |
| 5,591,006 | 1/1997 | Demeo et al. | 416/62 |
| 5,775,876 | 7/1998 | Walker et al. | 416/62 |

*Primary Examiner*—Christopher Verdier
*Attorney, Agent, or Firm*—Joseph N. Breaux

[57] ABSTRACT

Fan blade covers which are particularly useful for covering ceiling fan blades. The covers are easily removed and cleaned providing a safe means for cleaning ceiling fan blades. The covers are provided in numerous colors and decorative patterns allowing the selection of covers which match a room decor. The covers also comprise a balancing arrangement for the fan which includes a pocket positioned on the upper surface of the cover and a dispensing arrangement for dispensing and distributing deodorant throughout a room which includes a vented pocket for receiving a deodorant canister while the vented pocket and canister includes a visual deodorant depletion indicator.

7 Claims, 2 Drawing Sheets

FAN BLADE COVERS

TECHNICAL FIELD

The present invention relates to devices and methods for fan blades and more particularly to devices and methods for covering fan blades that allow the fan blades to be decorated to match a room decor, provides a protective washable cover which is easily removed and installed, provides a means for easily attaching fan blade balance weights and also includes a means for dispensing and distributing room deodorant.

BACKGROUND ART

Fans and particularly, ceiling fans collect a large amount of dust on their blades and become soiled rapidly as a result of their constant use and rotation. Effective cleaning of fan blades is extremely difficult since very small dust particles become imbedded in the microscopic pores of the fan blade material. Additionally, the difficulty of cleaning ceiling fan blades is compounded since the fans are usually out of reach and the job must be done while dangerously standing on a step ladder or chair.

Another problem associated with ceiling fans is the difficulty of changing the fan's color, such as when a room is redecorated or painted. Usually the only option is to change the ceiling fan, purchase new blades, or disassemble the fan and paint the blades separately.

Still another problem associated with ceiling fans is the difficulty of properly balancing the fan blades so that the fan rotates smoothly at all speeds. Balancing problems can be exacerbated from weight added by painting the ceiling fan blades, clip on deodorant canisters or by adding decorative blade covers.

The present invention solves these problems while also allowing the ceiling fan blades to be employed as room deodorant dispensers and distributors. Deodorant dispensers for rooms are usually cryptically designed to disguise them as common everyday household items such as a toilet paper holder, night light, decorative table top item, and so on. Seeing a room deodorizer is undesirable. Furthermore, these devices are not particularly effective for distributing room deodorant throughout an entire room. A rotating ceiling fan makes an ideal room deodorant dispenser and distributor. Room deodorizers attached to ceiling fans have been patented by Murcin et al., U.S. Pat. No. 5,022,819. The Murcin device attaches an air freshener packet to an existing ceiling fan blade by use of spring loaded U shaped clips. Although, this device extremely useful it is not, and cannot, be incorporated as part of a decorative fan blade cover as the present invention and the Murcin device, can cause the fan to become unbalanced.

Prior devices have been patented which provide covers for ceiling fan blades including Prucha et al, U.S. Pat. No. 4,832,572 which claims an elongated sleeve with an elastic closure at an opened end securing the sleeve on the fan blade. Prucha is an extremely useful fan blade cover, however it cannot provide the multiple uses, such as balancing the fan, and dispensing and distributing room deodorant, as the present invention. Other prior devices relating to ceiling fan blades include a fan blade patented by Junkin, U.S. Pat. No. 5,110,261 comprising a rigid frame covered by a flexible weather resistant cover. McKnight, U.S. Pat. No. 4,753,573 discloses an elongated strip of porous filtering material attached to the top or bottom surfaces of a fan blade. Burt, U.S. Pat. No. 4,889,543 discloses an air filtering system to be interconnected to adjacent blades of a fan by fastening means. Although these devices solve particular problems associated with fans or provide added benefits for fans, the prior devices do not and cannot be adapted to include a fan blade cover which allows the fan blades to be decorated to match a room decor, easily removed for cleaning, while also providing a means for balancing the fan and a means for dispensing and distributing room deodorant.

GENERAL SUMMARY DISCUSSION OF INVENTION

It is thus an object of the invention to provide a Fan Blade Cover that provides a protective, durable, easily removed and cleaned cover that allows ceiling fan blades to be cleaned while also providing a means for allowing the ceiling fan blade's color or pattern to be changed to match a room's decor.

It is a further object of the invention to provide a Fan Blade Cover that includes a means for balancing the fan, wherein the means includes a pocket formed on the top surface of the cover near the end of the fan blade which allows weights to be added or deleted from the fan blade as needed to effectively balance the fan.

It is a still further object of the invention to provide a Fan Blade Cover that provides a means for dispensing and distributing room deodorant wherein the means includes a vented deodorant pocket mounted on the bottom side of the blade cover for receiving a rechargeable deodorant canister, while the deodorant pocket and canister includes a visible deodorant depletion indicator, the positioning of the vented deodorant pocket allows air to waft through the pocket vents as the fan rotates thus distributing deodorant throughout the room.

Accordingly, Fan Blade Covers are provided which allows the cover to be easily removed and cleaned while the cover is also supplied in a number of colors and decorative patterns allowing the fan color to be changed to match the room decor as desired, the covers also provide a means for balancing the fan so that the fan rotates smoothly at all speeds wherein the balancing means includes a weight pocket positioned on the upper surface of the blade for receiving multiple weights, the cover also includes a means for dispensing and distributing deodorant wherein a vented deodorant canister pocket is provided on the bottom surface of the cover, while the deodorant pocket and canister also includes a visible deodorant depletion indicator, allowing the user to determine at a glance if the deodorant canister is empty.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the preceding description that the covers are made from durable washable material and are produced in a variety of colors, patterns and styles. The covers are constructed to resemble an elongated sleeve with one open end and the other end closed and shaped to resemble the end of a fan blade. The open end of the cover sleeve includes a means for securing the cover once the cover has been slipped over the fan blade. The covers are easily removed and installed which provides a safe means for cleaning ceiling fan blades since the usual method of cleaning fan blades requires a person to dangerously stand on a step ladder or chair. The material used to construct the covers should be machine washable and durable to withstand numerous machine washings. The covers include a means for balancing the fan by adding or deleting weights from a pocket positioned on the upper surface of the cover. The balancing means allows the fan to be balanced after attaching the covers which may be necessary since the covers add weight to the fan blades. The covers also include a means for dispensing and distributing deodorant throughout a room, wherein a vented pocket is positioned on the bottom surface of the cover which receives a deodorant canister, so that as the fan rotates moving air wafts through the vented pockets distributing scented air throughout the room. When the deodorant in the canister is depleted a visual deodorant depletion indicator alerts the user to add more scent to the canister.

Figure 1:
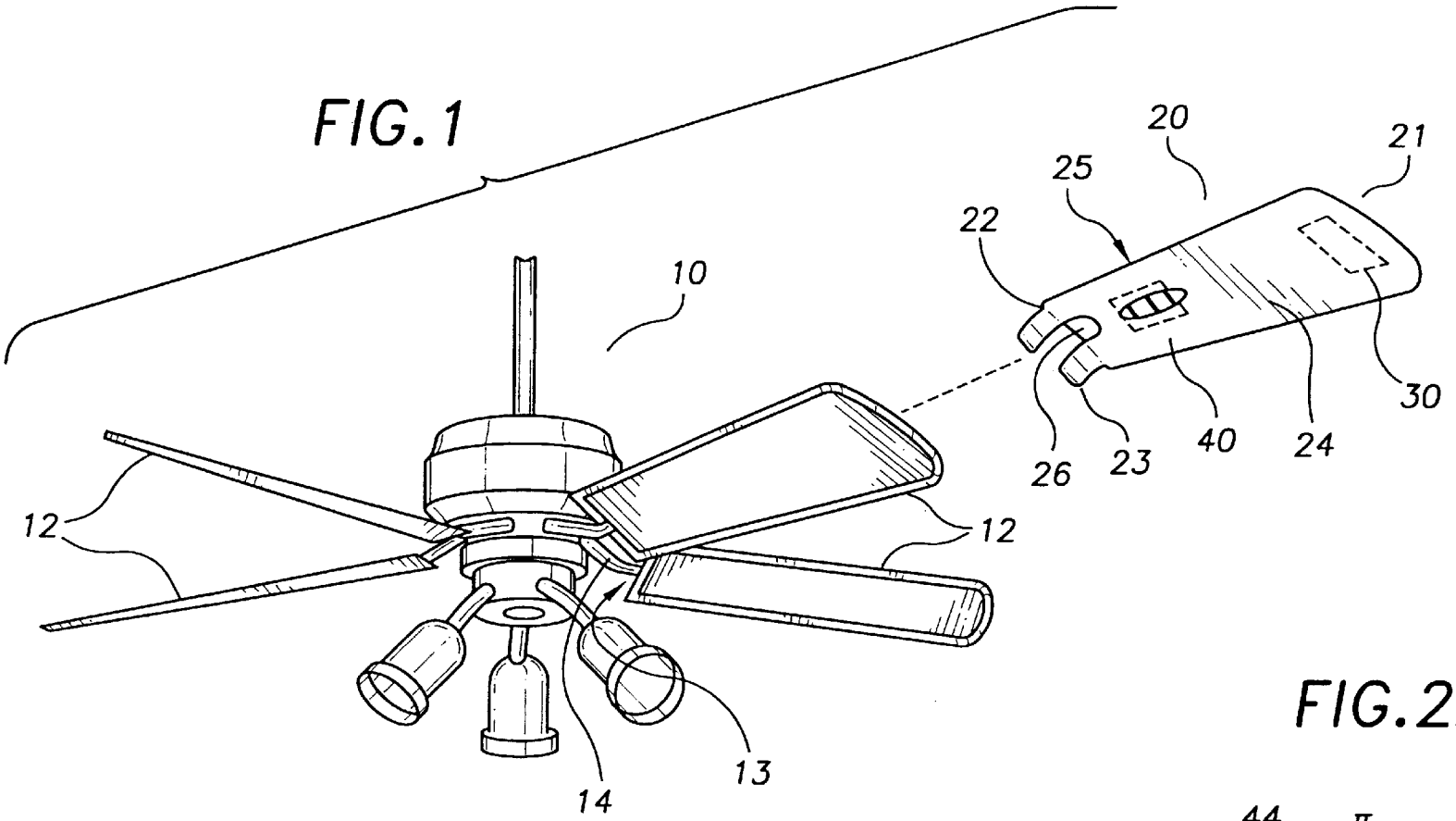
FIG. 1 is an illustration of a ceiling fan indicating the placement of the blade cover onto a typical ceiling fan blade.
Figure 2A:
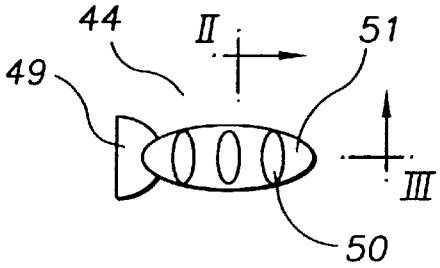
FIG. 2*a* is an enlarged view of the circular area in FIG. 2.
Figure 2:
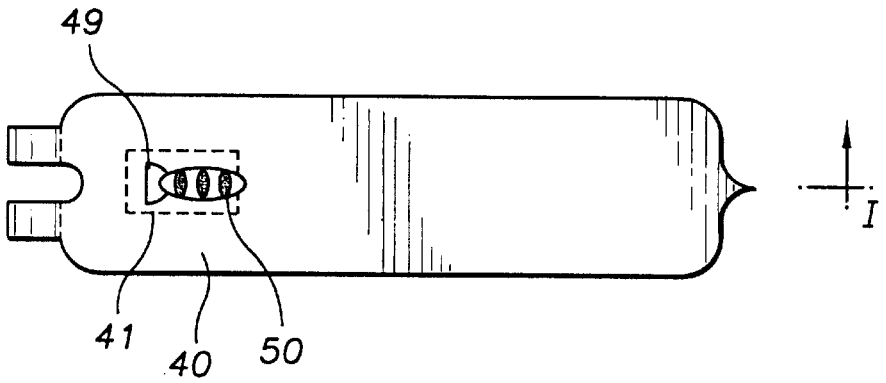
FIG. 2 is a bottom view of the blade cover illustrating the deodorant pocket, deodorant canister and deodorant visible depletion means in detail.

FIG. 1 illustrates a typical ceiling fan 10 with four fan blades 12 and the positioning of the fan blade cover 20 over one of the fan blades while the fan balancing means 30 is positioned on the upper surface of the cover and the deodorant dispensing and distributing means 40 is positioned on the bottom surface of the cover 20.

The cover 20 is constructed to resemble a sleeve with a closed end 21 and an opened end 22 for slipping over the fan blade. The material used to construct the cover is preferable a washable fabric such as SPANDEX$_{TM}$ which slips over the fan blade tightly. Other fabrics can also be used, such as cotton, nylon, and other synthetics, however the fabric used preferably does not shrink in normal machine washing and further is durable and has good dye retention. The fabric used may also include numerous colors, patterns and designs if desired so that covers can be chosen to match the room decor. The closed end of the cover 21 is secured by stitching while the open end 22 edges are also stitched to prevent fraying. The open end 22 also includes a means for securing the covers 20 on the fan blades. The securing means preferably includes two elongated fabric tabs 23 which extend from the cover bottom surface 24 and once the cover 20 is installed over a fan blade 12 the tabs wrap around the fan blade post end 13 and secure to the cover top surface 25 by use of VELCRO$_{TM}$. The cover open end 22 includes an indented section 26 which allows the cover 20 to be pulled up to the fan blade shaft 14. There may be other tab securing means other than VELCRO$_{TM}$ such as buttons and snaps. The securing means is not seen on the typical ceiling fan since the tabs 23 are attached on the top surface 25 of the cover 20 and the top surface 25 faces the ceiling of the room where the fan is installed.

Figure 3:
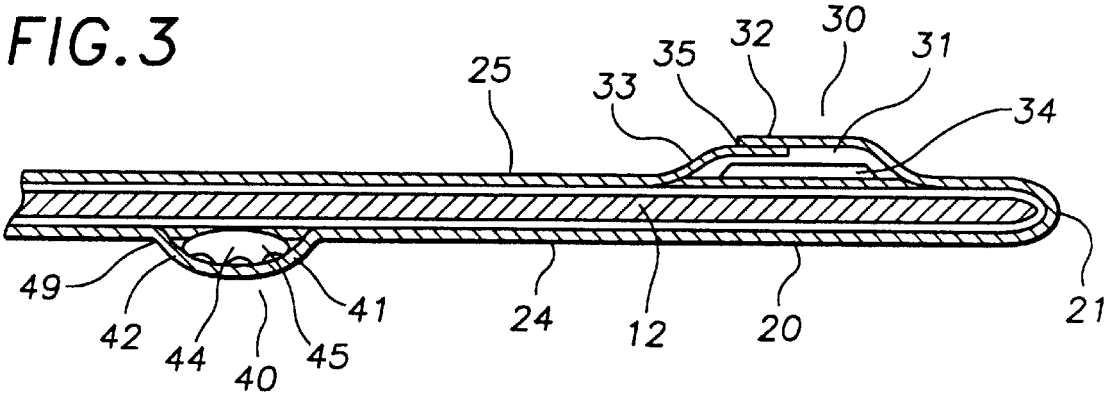
FIG. 3 is a cross section of a fan blade with the cover installed taken along line I—I of FIG. 2 Illustrating a cross section of the fan balancing pocket with a weight installed and the deodorant pocket with the deodorant canister installed.
Figure 4:
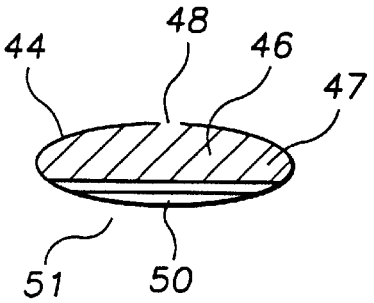
FIG. 4 is a cross section of the deodorant canister taken along line II—II of FIG. 2*a* illustrating the interior of the canister.
Figure 5:
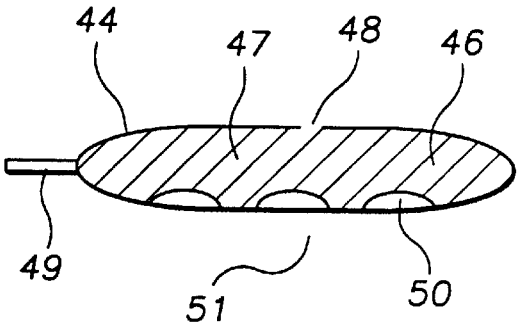
FIG. 5 is a cross section of the deodorant canister taken along line III—III of FIG. 2*a* illustrating the interior of the canister, the canister wick, the canister filing aperture, and the canister visual depletion indicators.

As illustrated in FIG. 3 the fan balancing means 30 includes a pocket 31 attached to the top surface 25 of the cover and formed as an integral part of the cover material. The pocket 31 includes an upper flap 32 and a lower flap 33 forming a space for receiving balancing weights 34. The flaps are preferably secured using VELCRO$_{TM}$ 35, while other securing means may be employed such as snaps and buttons. The flaps 32 and 33 are orientated to form an opening for entering the pocket in a direction which does not allow the weights 34 to exit the pocket 31 when the fan is rotating and forcing the weights to sling to the end of the fan blade. Additionally, the dimensions of the pocket 31 allow a multiplicity of weights to be placed in the pocket. The weights 34 used are preferably flat lead weights and may be formed to fit within the pocket 31 or may be cut to reduce weight added in a given pocket. The fan is balanced after all the covers 20 have been placed on all the fan blades, and further after the deodorant means 40 is also installed and loaded with deodorant. Balancing is accomplished by adding or deleting weights on each fan blade as needed.

The deodorant dispensing and distributing means 40 includes a vented pocket 41 which is positioned on the bottom surface of the cover 24 and is constructed of preferably meshed material with numerous pores 45 which is sewed directly onto the cover 20. The vented pocket 41 is also equipped with a VELCRO$_{TM}$ sealed flap 42 for sealing the vented pocket 41 after a deodorant canister 44 has been installed in the pocket 41. The deodorant canister 44 is a low profile oval plastic container with an interior reservoir 46 for storing scent. The interior is filled with absorbent material 47 which absorbs liquid scent and prevents the liquid scent from leaking from the canister inadvertently. The canister 44 is filled with liquid scent through filling aperture 48 which is located on the top of the canister 44. The liquid scent is wicked from the canister 44 through wick 49 which is in communication with the interior absorbent material 47 and while the other end of the wick is exposed to air which travels through the mesh material as the fan rotates. The wick 49 is preferably composed of felt material and may also be foam, spun cotton, or other material known to be highly absorbent. The absorbent material must also be inert to the liquid scent used. The canister 44 includes visual depletion indicators 50 which are visible from the bottom side 51 of the canister 44. There may be one or more visual depletion indicators. The depletion indicators change color or tint as the canister contents are depleted alerting the user of the fan and the covers that the deodorant should replenished. Liquid scent of any type may be used as long as the scent does not deteriorate the absorbent material.

It is noted that the embodiment of the Fan Blade Covers described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. Fan blade covers comprising: a multiplicity of covers each formed from material as an elongated sleeve with two ends, one end remaining open for inserting a fan blade while the other end is closed, wherein the fan blade includes a shaft end for connecting the fan blade to a fan rotating shaft, a blade terminal end, a top side not visible to a user of the fan and a bottom side, and where the sleeve open end comprises a means for securing the sleeve on the fan blade shaft end, wherein the securing means comprises a pair of securing tabs connected to the sleeve open end and which wrap around the shaft end of the fan blade securing the sleeve on the fan blade, the cover further comprising a fan balancing means which includes a pocket mounted on a top side of the sleeve, wherein the sleeve top side is on the fan blade top side and wherein the pocket is formed integrally from the cover material and further includes two flaps forming a secure pocket for receiving weighted material, the cover further comprises a room deodorant dispensing and distributing means which comprises a vented pocket located on a bottom side of the sleeve, wherein the bottom side of the sleeve is on the fan blade bottom side and wherein the vented pocket includes a multiplicity of vent apertures allowing air to travel in and out of the vented pocket and further wherein the vented pocket includes two sealing flaps allowing access into the vented pocket and the vented pocket is dimensioned to receive a deodorant dispensing canister which comprises a scent impermeable container with an interior filled with an absorbent material, a filling aperture allowing liquid scent material to be placed into the container interior, a wick with one end in communication with the absorbent material and one end in communication with the air traveling in and out of the vented pocket, the container further comprising a visual scent depletion indicator which visually indicates when the interior of the container is empty and full.

2. The fan blade covers of claim 1, wherein the covers further comprise the sleeves being elastic fabric material which assures the conformation of a cover with a fan blade shape.

3. The fan blade covers of claim 1, wherein the visual scent depletion means further comprises a visual color change means which changes color when the scent level in the container goes from the full level to the empty level.

4. The fan blade covers of claim 1, wherein the cover sleeve material further comprises material provided in numerous colors, designs, and patterns.

5. The fan blade covers of claim 1, wherein the visual scent depletion indicator further comprises a visual indicator which is visible by the user, and wherein the fan is a ceiling fan.

6. The fan blade covers of claim 1, wherein the fan balancing means further comprises the fan balancing means mounted on the top side of the cover and near the blade terminal end.

7. The fan blade covers of claim 1, wherein the room deodorant dispensing and distributing means further comprises the deodorant means mounted on the bottom side of the cover and near the shaft end of the fan blade.

* * * * *